US010053322B2

(12) United States Patent
Sato

(10) Patent No.: US 10,053,322 B2
(45) Date of Patent: Aug. 21, 2018

(54) MEANDERING CORRECTION DEVICE, ROLL MEDIUM CONVEYANCE DEVICE, AND IMAGE PROCESSING DEVICE

(71) Applicant: Oki Data Corporation, Tokyo (JP)

(72) Inventor: Osamu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 408 days.

(21) Appl. No.: 14/883,221

(22) Filed: Oct. 14, 2015

(65) Prior Publication Data

US 2016/0221785 A1 Aug. 4, 2016

(30) Foreign Application Priority Data

Jan. 29, 2015 (JP) ..... 2015-015219

(51) Int. Cl.

*B65H 23/038* (2006.01)
*B41J 15/04* (2006.01)
*B65H 23/04* (2006.01)

(52) U.S. Cl.

CPC ..... *B65H 23/038* (2013.01); *B41J 15/04* (2013.01); *B65H 23/048* (2013.01); *B65H 2301/331* (2013.01); *B65H 2404/15212* (2013.01); *B65H 2511/112* (2013.01); *B65H 2553/412* (2013.01); *B65H 2701/1315* (2013.01); *B65H 2801/12* (2013.01)

(58) Field of Classification Search

CPC ..... B65H 23/038; B65H 23/048; B65H 2511/112; B65H 2301/331; B65H 2701/1315; B65H 2553/412; B65H 2404/15212; B65H 2801/12; B41J 15/04

See application file for complete search history.

(56) References Cited

U.S. PATENT DOCUMENTS 3,107,036 A * 10/1963 Alexeff ..... B65H 23/02 226/16
3,380,637 A * 4/1968 Knapp ..... B65H 23/038 226/20
3,436,002 A * 4/1969 Racine ..... B65H 23/038 226/23
4,243,167 A * 1/1981 Sander ..... B65H 23/038 226/21

(Continued)

FOREIGN PATENT DOCUMENTS

JP 2008-230733 A 10/2008

*Primary Examiner* — William Arauz Rivera
(74) *Attorney, Agent, or Firm* — Metrolexis Law Group, PLLC

(57) ABSTRACT

A meandering correction device for a roll medium includes: a first roll medium conveyance unit; a second roll medium conveyance unit disposed downstream of the first roll medium conveyance unit in a conveyance path for a roll medium; a meandering correction roller located between the first roll medium conveyance unit and the second roll medium conveyance unit in the conveyance path and being vertically downwardly in contact with the roll medium to thereby apply a tension to the roll medium. The meandering correction roller includes a rotational shaft whose direction is changeable. A change in the direction of the rotational shaft causes a position of the roll medium in contact with the meandering correction roller to move in the direction of the rotational shaft.

7 Claims, 16 Drawing Sheets

(56) References Cited

U.S. PATENT DOCUMENTS

| | | | | | |
|---|---|---|---|---|---|
| 4,552,295 | A * | 11/1985 | Smith | B65H 23/34 | 198/807 |
| 4,835,547 | A * | 5/1989 | Okushi | B41J 15/16 | 226/15 |
| 5,226,577 | A * | 7/1993 | Kohler | B65H 23/038 | 226/18 |
| 5,397,043 | A * | 3/1995 | Blanding | B65H 23/038 | 226/21 |
| 5,720,447 | A * | 2/1998 | Brechko | B65H 23/0326 | 242/563.1 |
| 5,906,305 | A * | 5/1999 | Knorr | B65H 23/038 | 198/807 |
| 6,584,900 | B2 * | 7/2003 | De Vroome | B65H 23/038 | 101/228 |
| 6,676,066 | B2 * | 1/2004 | Keel | B65H 23/02 | 226/21 |
| 8,308,037 | B2 * | 11/2012 | Muir | B65H 23/038 | 226/194 |
| 8,403,252 | B2 * | 3/2013 | Muir | B65H 23/038 | 226/1 |
| 9,796,010 | B2 * | 10/2017 | Hofer | B21C 47/3425 | |

* cited by examiner 2
23
25
28
29
HP
m1
m2
A
Z
Y

MEANDERING CORRECTION DEVICE, ROLL MEDIUM CONVEYANCE DEVICE, AND IMAGE PROCESSING DEVICE

CROSS REFERENCE TO RELATED APPLICATIONS

This application claims priority based on 35 USC 119 from prior Japanese Patent Application No. 2015-015219 filed on Jan. 29, 2015, entitled "MEANDERING CORRECTION DEVICE, ROLL MEDIUM CONVEYANCE DEVICE, AND IMAGE PROCESSING DEVICE", the entire contents of which are incorporated herein by reference.

BACKGROUND OF THE INVENTION

1. Field of the Invention

This disclosure relates to a meandering correction device, and particularly to a meandering correction device employed in a roll medium conveyance device that conveys rolled paper.

2. Description of Related Art

In the conveyance of rolled paper (long length), the sheet is conveyed while meandering because due to environmental changes, the tension of the paper sheet changes due to the expansion or contraction of the paper sheet and the conveyance rollers. This is an obstructive factor for proper sheet conveyance. To address this, a device is needed that corrects meandering and/or a tensioner roller device is needed that applies tension to a paper sheet to absorb a change in the feed amount due the expansion/contraction of the paper sheet and/or conveyance rollers or other factor. For instance, some apparatuses employ a configuration that includes a sheet position correction unit that corrects any meandering of rolled paper picked up and delivered from a paper supply unit, and a conveyance reference roll that is installed downstream of the sheet position correction unit and that applies tension to the rolled paper (for instance, see Japanese Patent Application Publication No. 2008-230733 (FIG. 1 on page 5)).

SUMMARY OF THE INVENTION

However, the above configuration has the following problems. As one example, since a tensioner roller device that absorbs a change in the feed amount of a paper sheet and a device that corrects meandering are disposed separately and independently, the entire size of the apparatus tends to be large. As another example, if a tensioner roller device is provided downstream of a meandering correction device and is inclined in its position (parallelism), the tensioner roller may cause a paper sheet to meander again while conveying the paper sheet therethrough. For this reason, the tensioner roller needs to be adjusted.

An aspect of the invention is a meandering correction device for a roll medium that includes: a first roll medium conveyance unit; a second roll medium conveyance unit disposed downstream of the first roll medium conveyance unit in the conveyance path of the roll medium; a meandering correction roller located between the first roll medium conveyance unit and the second roll medium conveyance unit in the conveyance path and being vertically downwardly in contact with the roll medium to thereby apply a tension to the roll medium. The meandering correction roller includes a rotational shaft whose direction is changeable. A change in the direction of the rotational shaft causes a position of the roll medium in contact with the meandering correction roller to move in the direction of the rotational shaft.

According to the aspect of the invention, tension application and meandering correction can be made to a roll medium, thereby making it possible to simplify the configuration of the device and adjustment of the device.

BRIEF DESCRIPTION OF THE DRAWINGS

FIG. 16A is the main configuration diagram when the device is seen from the right side, and FIG. 16B is the main configuration diagram when the device is seen from the left side;

FIG. 17A is the main configuration diagram when the device is seen from the right side, and FIG. 17B is the main configuration diagram when the device is seen from the left side;

DETAILED DESCRIPTION OF EMBODIMENTS

Figure 1:
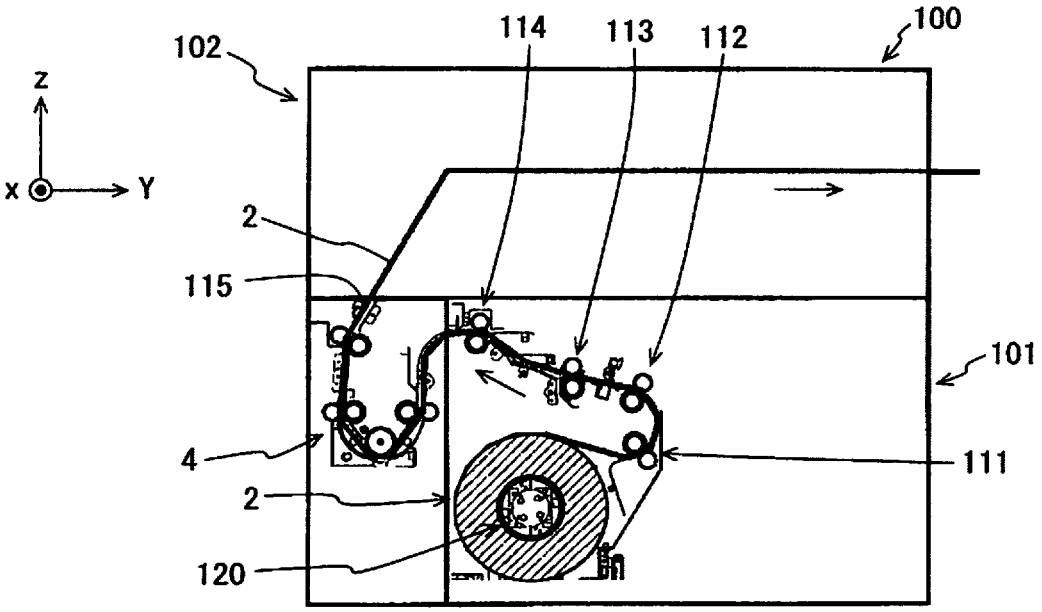
FIG. 1 is the main configuration diagram schematically illustrating the main configuration of an image formation apparatus that employs a meandering correction device of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

Figure 2:
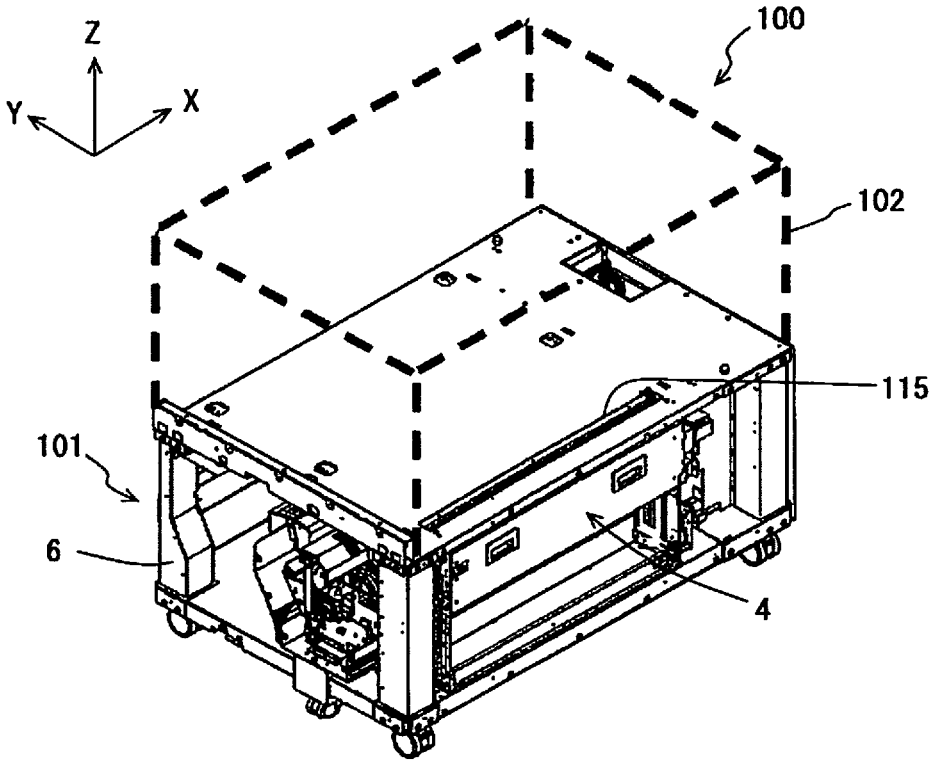
FIG. 2 is an appearance perspective view of the image formation apparatus.

FIG. 1 is the main configuration diagram schematically illustrating the main configuration of image formation apparatus 100 that employs a meandering correction device of the invention, and FIG. 2 is an appearance perspective view of image formation apparatus 100. However, in FIG. 2, in order to clearly illustrate the internal configuration, the surrounding cover of roll sheet conveyance device 101 is removed and only the external shape of image formation unit 102 is illustrated with dotted lines.

In mainframe 6, roll sheet conveyance device 101 as a roll medium conveyance device includes rolled paper rotational shaft 120 to which rolled paper 2 is rotatably attached, conveyance roller pairs 111 to 114 that guide rolled paper 2 to the downstream side along a predetermined conveyance path, and meandering correction unit 4 as a meandering correction device which is disposed on the downstream side of conveyance roller set 114 in the sheet conveyance direction. It is to be noted that rolled paper rotational shaft 120 and conveyance roller pairs 111 to 114 each correspond to a sheet supply unit, and rotate upon receiving power transmitted from a drive source (not illustrated) via a gear train, so as to convey rolled paper 2 to the downstream side.

As described later, meandering correction unit 4 corrects the meandering of delivered rolled paper 2, then delivers rolled paper 2 to image formation unit 102 and to an image processor through rolled paper discharge outlet 115. Rolled paper 2 sent into image formation unit 102 is passed through a toner image formation unit, a transfer unit, and a fixing unit (not illustrated) in image formation unit 102, and is printed with an image, then is discharged to the outside.

It is to be noted that between the X, Y, Z axes in FIG. 1, let the X-axis be the axial direction of rolled paper rotational shaft 120, the Z-axis be the vertical direction, and the Y-axis be the direction perpendicular to both the X and Z axes. Also, when the X, Y, Z axes are illustrated in the later-described other drawings, these axial directions indicate common directions. In other words, the X, Y, Z axes in each drawing indicate the arrangement directions when image formation apparatus 100 illustrated in FIG. 1 is formed of the illustrated portions in the drawings.

Figure 3:
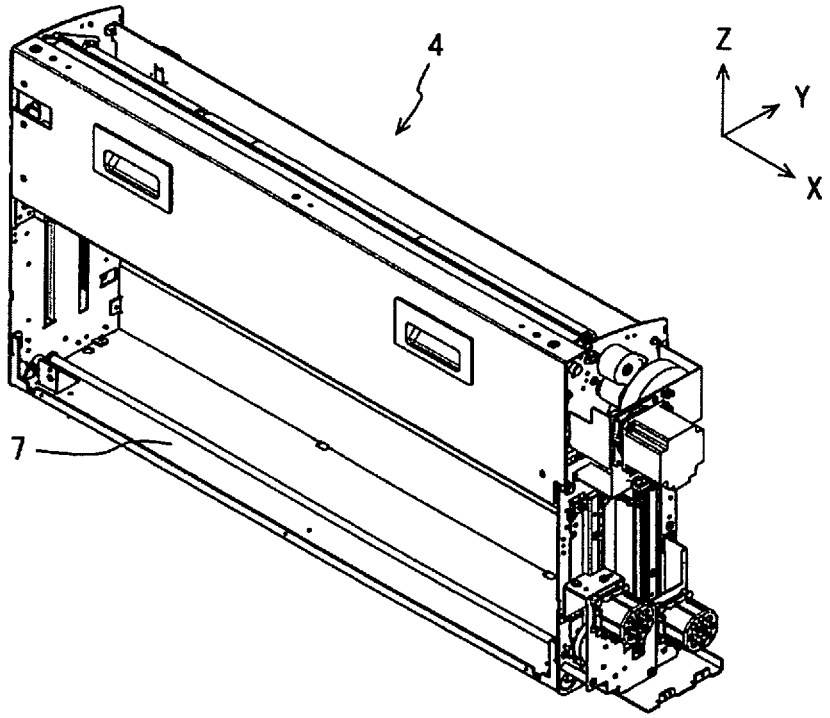
FIG. 3 is an appearance perspective view of a meandering correction unit according to the invention.
Figure 4:
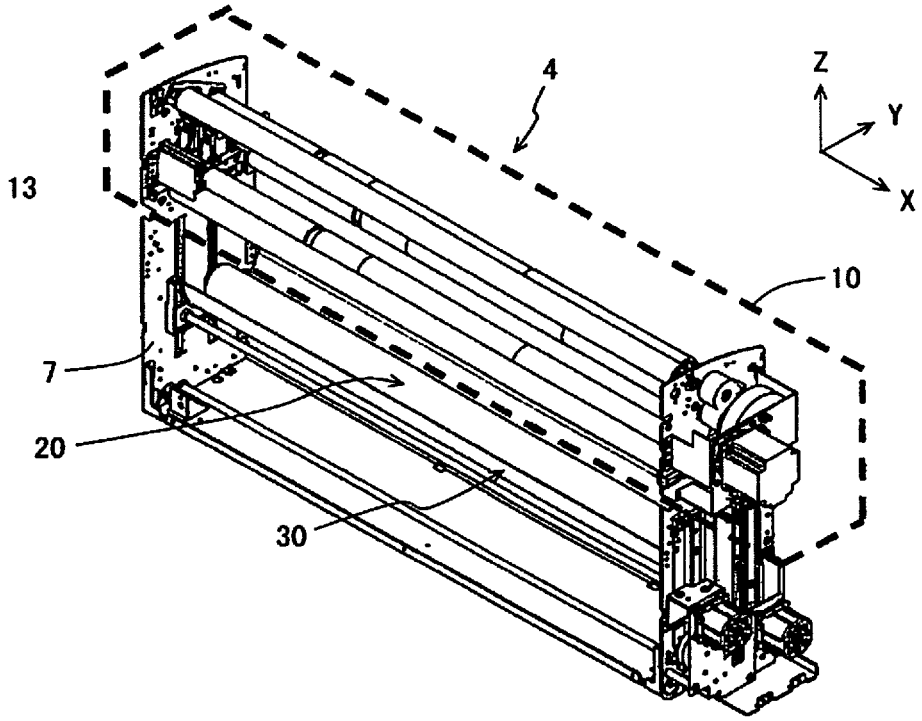
FIG. 4 is an appearance perspective view illustrating the inside of the meandering correction unit according to the invention with exterior components such as a cover removed.

Next, the configuration of meandering correction unit 4 according to the invention is described. FIG. 3 is an appearance perspective view of meandering correction unit 4, and FIG. 4 is an appearance perspective view illustrating the inside of meandering correction unit 4 with exterior components such as a cover removed. As illustrated in FIGS. 3 and 4, meandering correction unit 4 includes line feed (LF) unit 10 (portion enclosed by a dotted line) mounted on frame 7 as the base, tensioner roller unit 20, and guide sheet unit 30.

Figure 5:
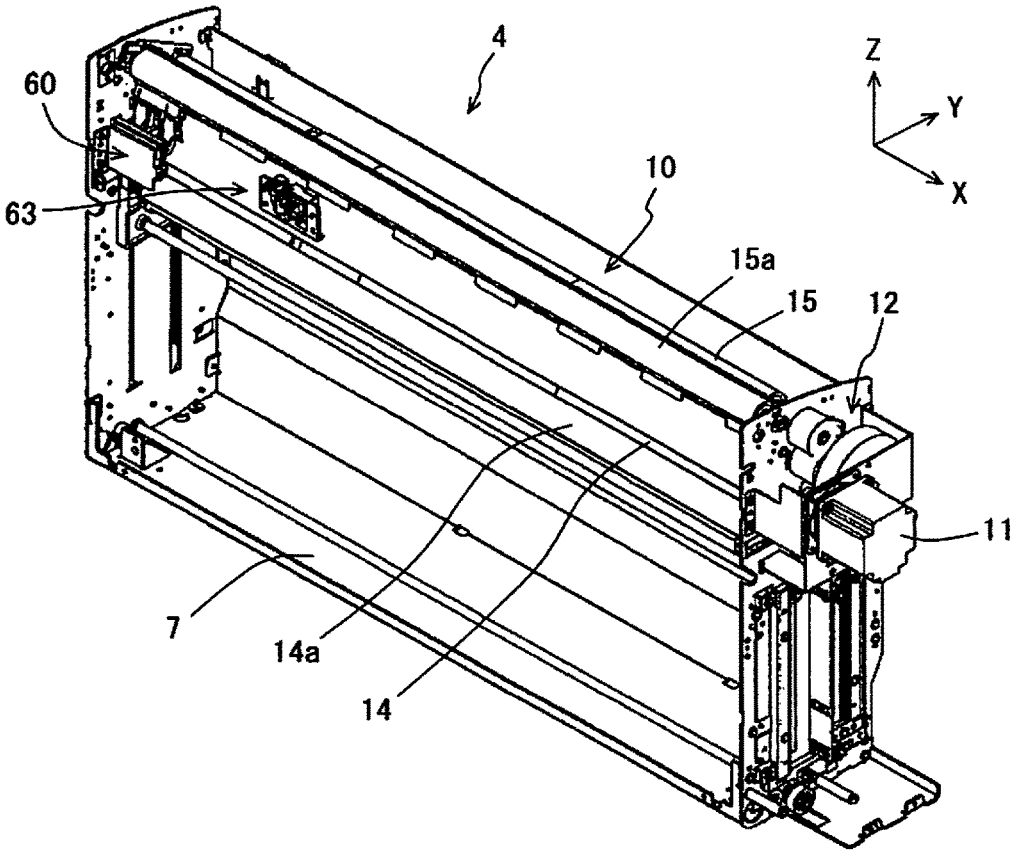
FIG. 5 is an appearance perspective view for illustrating the configuration of the LF unit in the meandering correction unit, with other constituting members in the meandering correction unit partially omitted.
Figure 6:
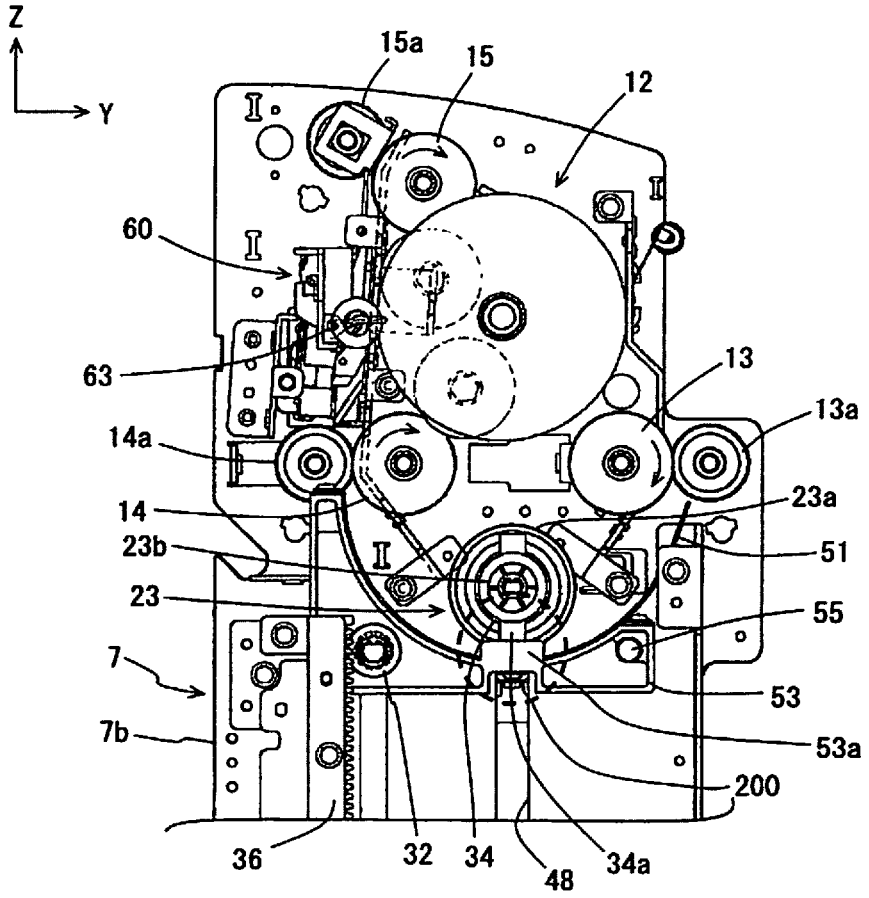
FIG. 6 is the main configuration diagram of the upper-half portion of a meandering correction unit in a first embodiment as seen in the axial direction (from the positive side of the X-axis) of the rotational axis of rolled paper.

FIG. 5 is an appearance perspective view for illustrating the configuration of LF unit 10 in meandering correction unit 4, with other constituting members in meandering correction unit 4 partially omitted. FIG. 6 is the main configuration diagram of the upper-half portion of meandering correction unit 4 as seen in the axial direction (from the positive side of the X-axis) of rotational axis 120 of rolled paper.

As illustrated in FIG. 5 and FIG. 6, LF unit 10 includes LF motor 11, gear train 12, first conveyance roller 13 (FIG. 6), second conveyance roller 14, third conveyance roller 15, first driven roller 13*a*, second driven roller 14*a*, and third driven roller 15*a*. It is to be noted that the front (the negative side of the Y-axis), rear, left and right of each portion of meandering correction unit 4 may be identified as seen from the negative side of the Y-axis. in the direction in which meandering correction unit 4, illustrated in FIGS. 3 to 5, indicates the front view. The right and left direction (the X-axis direction) may be referred to as the longitudinal direction of meandering correction unit 4.

As illustrated in FIG. 6, first conveyance roller 13, second conveyance roller 14, and third conveyance roller 15 are disposed in that order along the conveyance path of rolled paper 2 in meandering correction unit 4 from the upstream side in the conveyance direction. Second conveyance roller 14 and third conveyance roller 15 receive a rotational force from LF motor 11 (FIG. 5) via gear train 12. The rollers rotate in the direction of the arrows along with the rotation of LF motor 11. First conveyance roller 13 receives the rotational force of first conveyance motor 47 (FIG. 15) via a gear train (not illustrated) and rotates in the direction of the arrow along with the rotation of first conveyance motor 47.

First driven roller 13*a*, second driven roller 14*a*, and third driven roller 15*a* are disposed in pressure contact with first conveyance roller 13, second conveyance roller 14, and third conveyance roller 15, respectively, and in pressure contact as well with conveyance pinched rolled paper 2 to the downstream side as described later. It is to be noted that first conveyance roller 13 and first driven roller 13*a* correspond to the first roll medium conveyance unit, and second conveyance roller 14 and second driven roller 14*a* correspond to the second roll medium conveyance unit.

Figure 7:
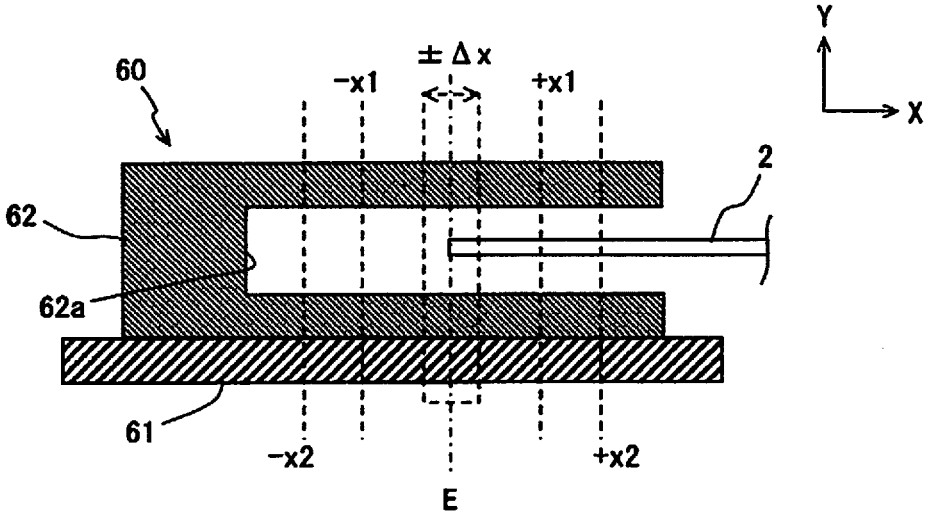
FIG. 7 is the main configuration diagram illustrating the fundamental configuration of a meandering detection sensor.

Between second conveyance roller 14 and third conveyance roller 15 in the conveyance path of rolled paper 2, there are disposed meandering detection sensor 60 as a meandering detector that detects the widthwise end position of conveyed rolled paper 2, and sheet detection sensor 63 for detecting the presence of rolled paper 2. FIG. 7 is the main configuration diagram illustrating the fundamental configuration of a meandering detection sensor 60.

Figure 15:
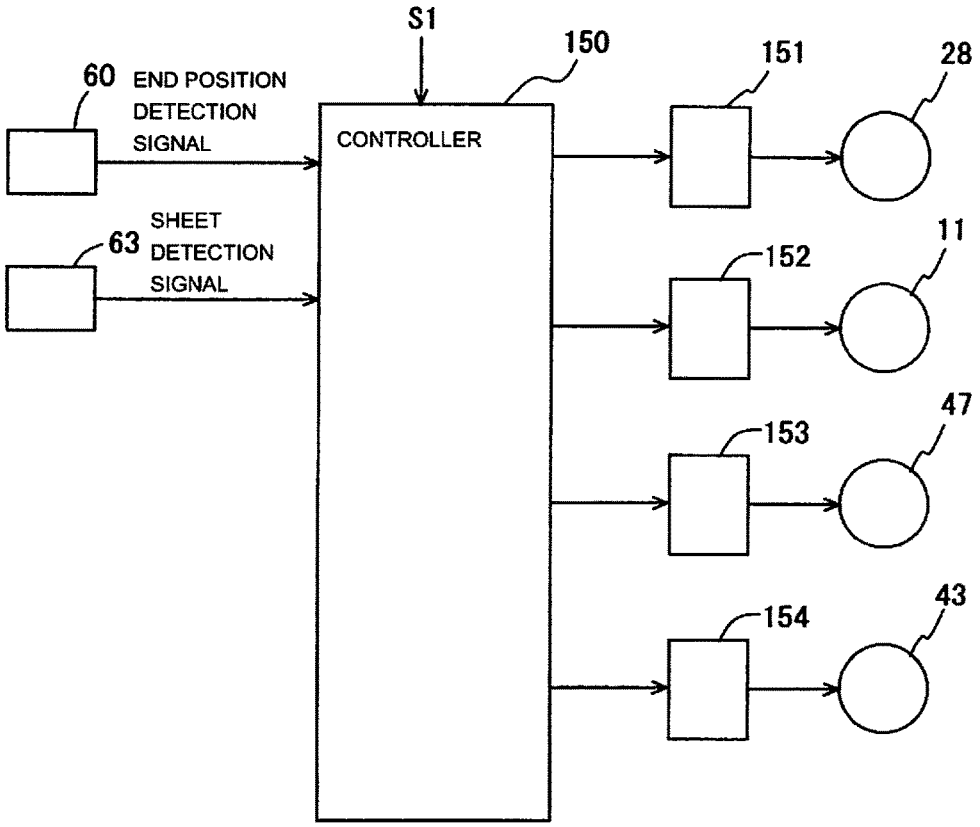
FIG. 15 is a block diagram illustrating the main configuration of a control system of the meandering correction unit in the first embodiment.

As illustrated in FIG. 5, this meandering detection sensor 60 is disposed to be opposed to the left end of conveyed rolled paper 2 in the width direction (the X-axis direction), and includes meandering detection sensor 62 fixed to frame 7 via bracket 61 as illustrated in FIG. 7. Meandering detection sensor 62 is formed in a U-shape in the sectional view and has an end position detection depressed portion 62*a* whose end is displaced to the right or left (the X-axis direction) according to the meandering caused by the left side end of rolled paper 2. An end position detection signal which changes according to the end position is outputted to a later-described meandering controller 150 (FIG. 15). It is to be noted that in the end position detection signal here, a voltage changes linearly according to the left side end position of rolled paper 2 as described later.

Figure 8:
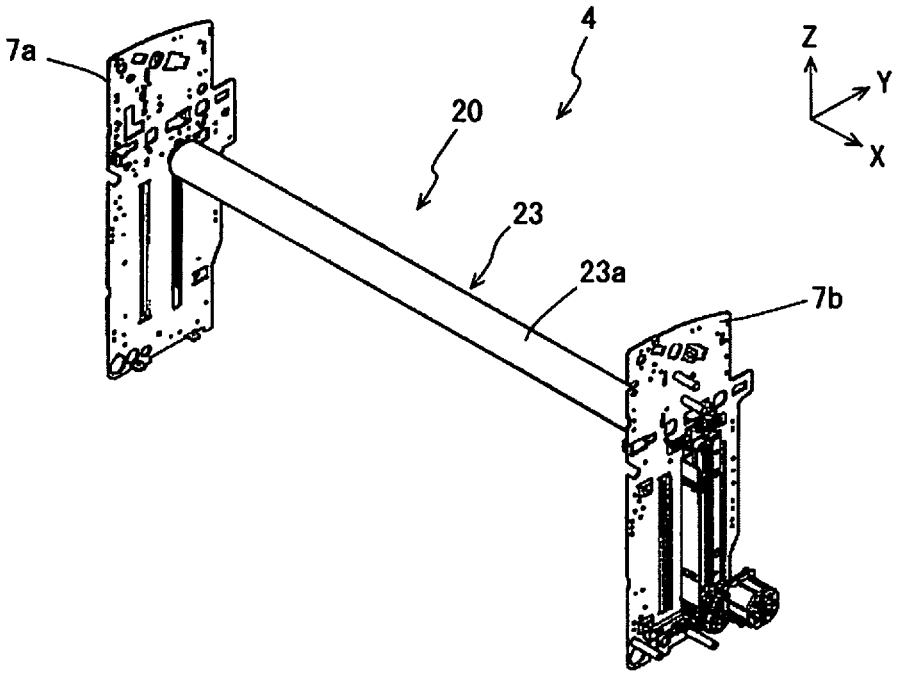
FIG. 8 is an appearance perspective view for illustrating the configuration of a tensioner roller unit in the meandering correction unit.
Figure 9:
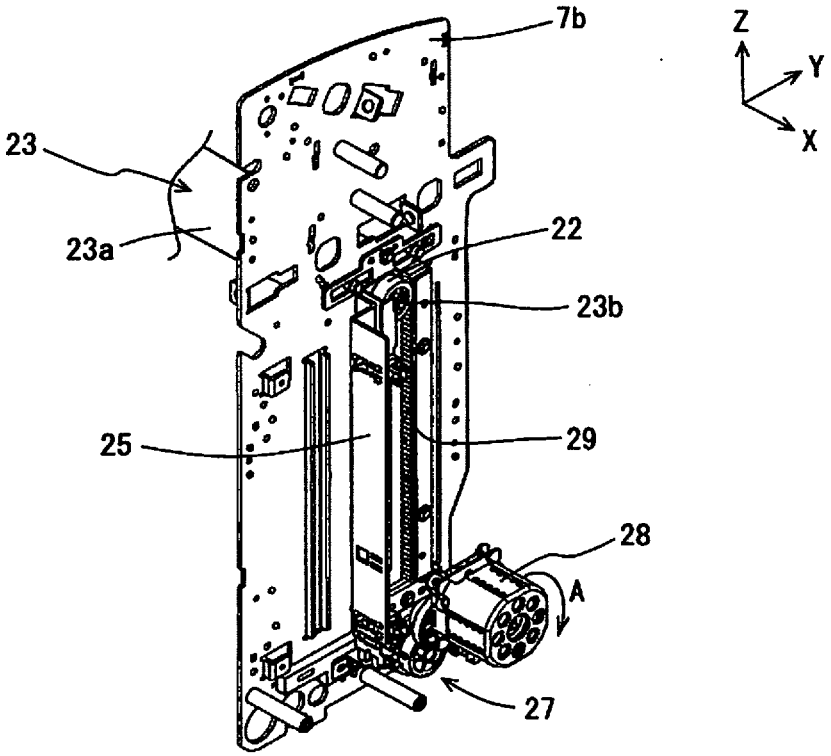
FIG. 9 is a partial enlarged view of the right side wall of the frame in FIG. 8.
Figure 10:
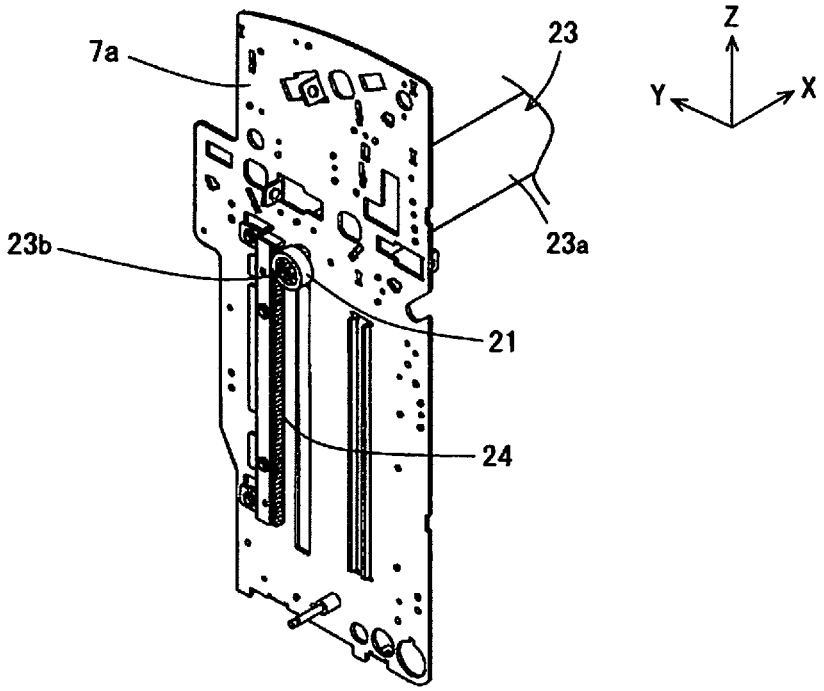
FIG. 10 is a partial enlarged view of the left side wall of the frame in FIG. 8 as seen from a different angle.
Figure 11:
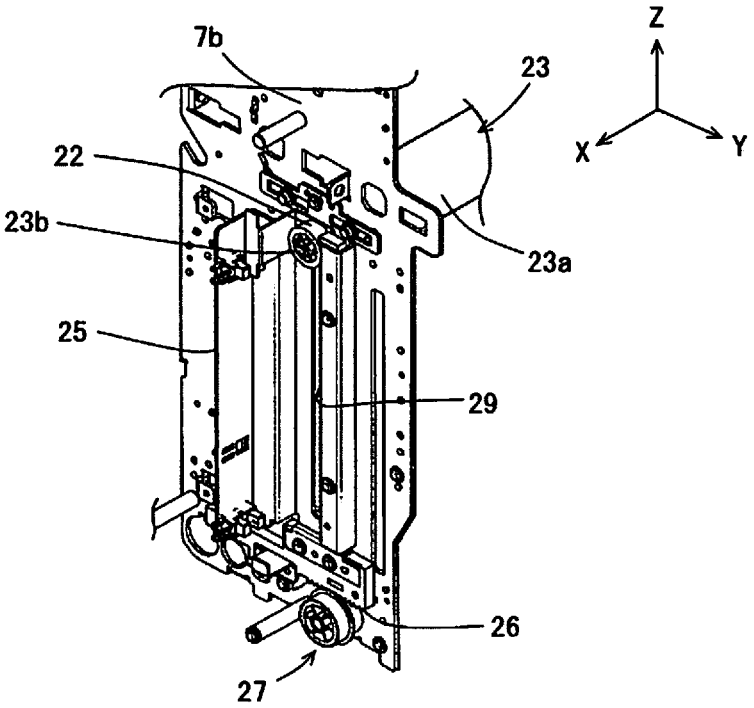
FIG. 11 is a partial enlarged view of the right side wall as seen from a different angle from that in FIG. 9.

FIG. 8 is an appearance perspective view for illustrating the configuration of tensioner roller unit 20 in the meandering correction unit 4. FIG. 9 is a partial enlarged view of right side wall 7*b* of frame 7 in FIG. 8. FIG. 10 is a partial enlarged view of the left side wall 7*a* of frame 7 in FIG. 8 as seen from a different angle; and FIG. 11 is a partial enlarged view of the right side wall 7*b* as seen from a different angle from that in FIG. 9. In FIGS. 8 to 11, the constituting members other than tensioner roller unit 20 in meandering correction unit 4 are omitted as needed.

As illustrated in these figures, tensioner roller unit 20 includes: tensioner roller 23 as the meandering correction roller having a rotational shaft with both ends fixedly disposed to left end gear 21 as a first end gear and right end gear 22 as a second end gear; left vertical rack 24 as a first vertical rack disposed in the vertical direction (the Z-axis direction) on left side wall 7*a* so as to be engaged with the left end gear 21; right vertical rack 29 as a second vertical rack disposed in the vertical direction (the Z-axis direction) so as to be engaged with the right end gear 22; meandering correction bracket 25 as a meandering correction movement member that holds right vertical rack 29 and is held by right side wall 7*b* in a manner slidable in the front and rear direction (the Y-axis direction); meandering correction rack 26 fixedly disposed on meandering correction bracket 25 in the front and rear direction; and meandering correction motor 28 that is connected to meandering correction rack 26 via gear train 27 and that drives to move meandering correction bracket 25 in the front and rear direction (the Y-axis direction).

The left side wall 7*a* slidably holds the left side of tensioner roller 23 so that left end gear 21 is movable in the vertical direction while being engaged with left vertical rack 24. The meandering correction bracket 25 slidably holds the right side of tensioner roller 23 so that right end gear 22 is movable in the vertical direction while being engaged with right vertical rack 29.

As illustrated in FIG. 6, FIG. 10, and FIG. 11, tensioner roller 23 has: roller portion 23*a*, axial portion 23*b* as a rotational shaft, left end gear 21 fixed to the left end of axial portion 23*b*, right end gear 22 fixed to the right end of axial portion 23*b*, brackets 34 disposed at axial portion 23*b* on both sides of roller portion 23*a*, and spacer 34*a* provided in bracket 34. Roller portion 23*a* and each bracket 34 are freely rotatable with respect to axial portion 23*b*. Spacer 34*a* of bracket 34 is fitted in vertical guide groove 48 formed in right side wall 7*b* and moves along with vertical movement of tensioner roller 23 while maintaining the same posture as described later. It is to be noted that although only the configuration of the right side of roller portion 23*a* has been described here, the left side of roller portion 23*a* is similarly formed.

As illustrated in FIG. 6, tensioner roller 23 is between first conveyance roller 13 and second conveyance rollers 14 in the conveyance path of rolled paper 2, and is disposed vertically above conveyed rolled paper 2 as described later (see FIGS. 16A and 16B). Tensioner roller 23 moves in the vertical direction (the Z-axis direction) while maintaining the horizontal direction due to the operation of left vertical rack and right vertical rack 29 with which right and left end gears 21, 22 are fixedly engaged to the right and left ends of axial portion 23*b*, respectively. Therefore, tensioner roller 23 repeats the vertical movement by a downward force exerted due to its own weight and an upward force due to the tension of rolled paper 2 in contact with tensioner roller 23 so that the tension becomes approximately constant.

Also, in tensioner roller 23, the right end thereof moves in the front and rear directions (the Y-axis direction) due to the rotation of meandering correction motor 28, and thus the direction of the rotational shaft changes and the meandering of rolled paper 2 can be corrected as described later.

Figure 12:
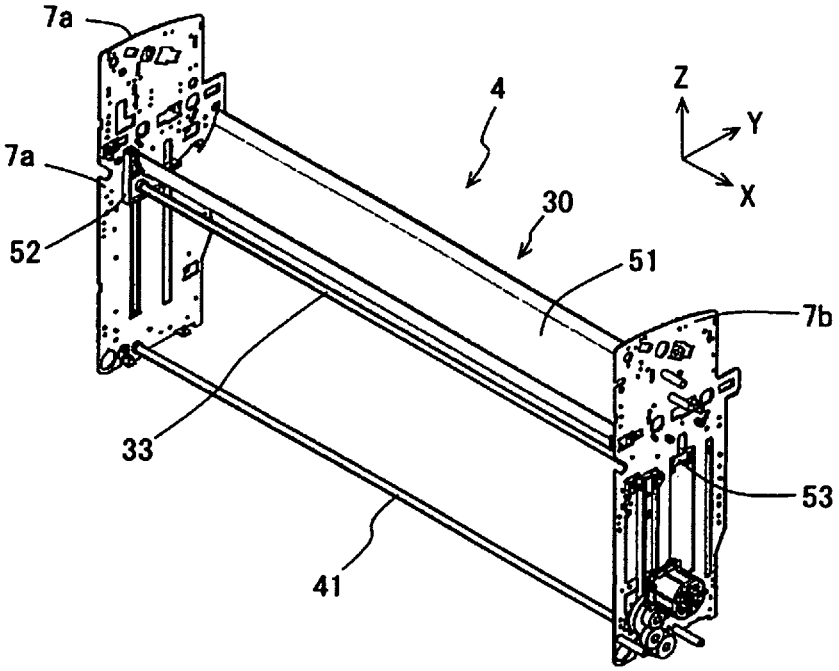
FIG. 12 is an appearance perspective view for illustrating the configuration of a guide sheet unit in the meandering correction unit.
Figure 13:
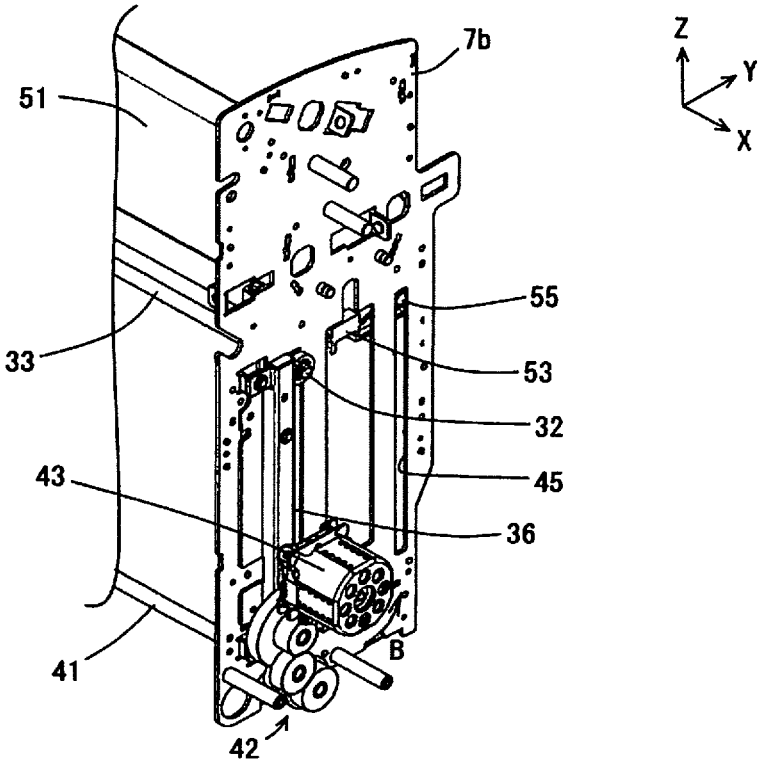
FIG. 13 is a partial enlarged view of the right side wall of the frame in FIG. 12.
Figure 14:
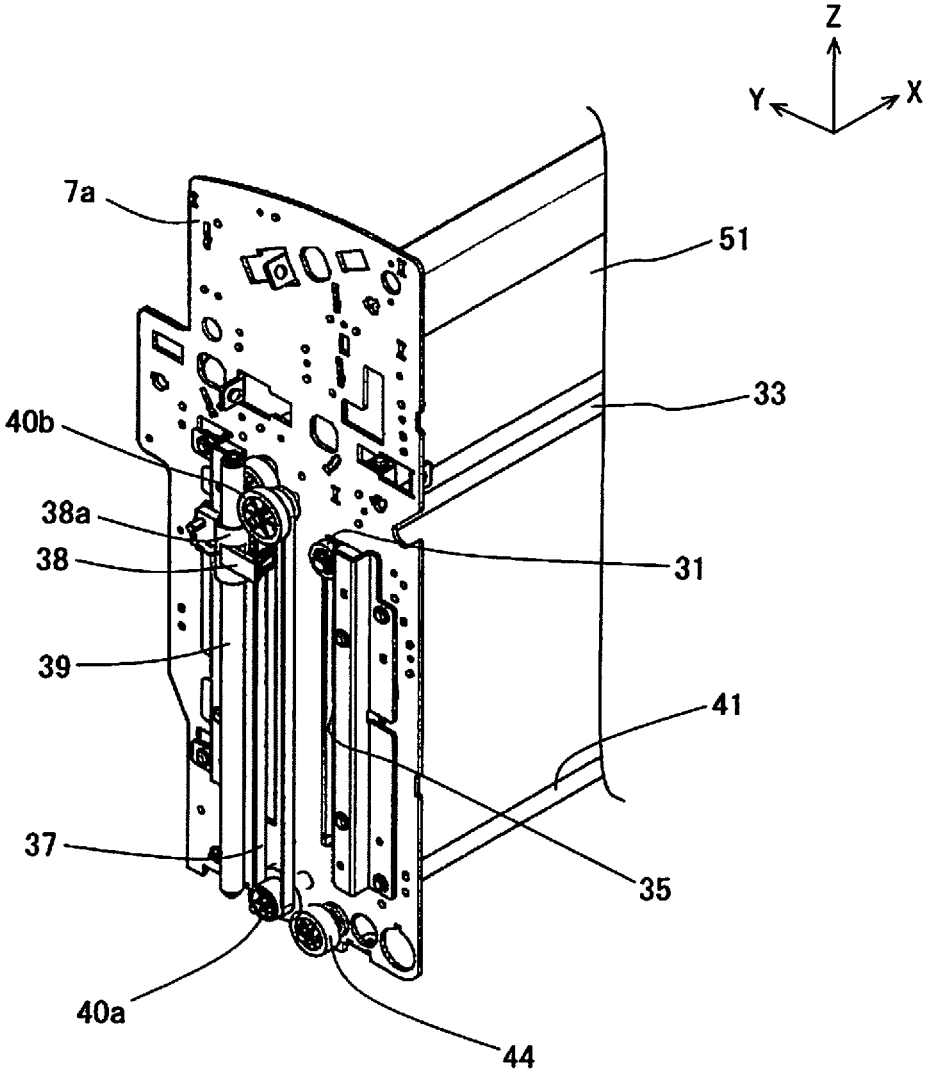
FIG. 14 is a partial enlarged view of the left side wall of the frame in FIG. 12 as seen from a different angle.

FIG. 12 is an appearance perspective view for illustrating the configuration of guide sheet unit 30 in meandering correction unit 4, FIG. 13 is a partial enlarged view of the right side wall 7*b* of frame 7 in FIG. 12, and FIG. 14 is a partial enlarged view of the left side wall 7*a* of frame 7 in FIG. as seen from a different angle. In FIGS. 12 to 14, the constituting members other than guide sheet unit 30 in meandering correction unit 4 are omitted as needed.

As illustrated in these figures, guide sheet unit 30 includes: guide member 51 that is formed in a substantially circular shape in the sectional view and that extends in the longitudinal direction (the X-axis direction); left end member 52 that is disposed to face to left side wall 7*a* and that holds left side end of guide member 51; right end member 53 that is disposed to face to right side wall 7*b* and that holds left side end of guide member 51; first drive shaft 33 that is rotatably held by left end member 52 and right end member 53 and extends to the outside of left and right side walls 7*a*, 7*b*, the first drive shaft 33 having both ends fixedly disposed to left end gear 31 and right end gear 32; left vertical rack 35 disposed in the vertical direction (the Z-axis direction) on left side wall 7*a* so as to be engaged with left end gear 31; right vertical rack 36 disposed in the vertical direction (the Z-axis direction) on right side wall 7*b* so as to be engaged with right end gear 32; carriage 38 including cylinder portion 38*a* that extends from left end member 52 to the outside of left side wall 7*a* through an opening and is formed in the vertical direction; guide shaft 39 disposed in the vertical direction (the Z-axis direction) on left side wall 7*a* so as to be fitted in the internal hollow of cylinder portion 38*a*; conveyance belt 37 disposed along guide shaft 39 and partially fixed to carriage 38; drive gear pulley 40*a* and driven pulley 40*b* disposed on left side wall 7*a* to stretch and drive conveyance belt 37; second drive shaft 41 that extends to the outside of left and right side walls 7*a*, 7*b*, and has a left end fixed to drive gear 44 to be engaged with drive gear pulley 40*a*; sheet up-and-down motor 43 that drives and rotates second drive shaft 41 via gear train 42 disposed on right side wall 7*b*; and guide projection 55 that is formed on right end member 53 to be fitted in guide long hole 45 which is formed in right side wall 7*b* in the vertical direction. It is to be noted that integrally formed guide member 51, left end member 52, right end member 53, and carriage 38 may be referred to as guide assembly 56 (FIGS. 16A and 16B).

When a sheet is conveyed by conveyance belt 37 and carriage 38 is guided by guide shaft 39 to move in the vertical direction, along with the movement, left end member 52, first drive shaft 33 engaged with left and right vertical racks 35, 36, and right end member 53 that rotatably holds first drive shaft 33 and that is guided by guide long hole 45 are also translated in parallel in the vertical direction.

Therefore, guide member 51 moves in the vertical direction by the rotation of sheet up-and-down motor 43 while maintaining the same posture.

FIG. 15 is a block diagram illustrating the main configuration of a control system of the meandering correction unit 4.

In FIG. 15, as illustrated in FIG. 7, rolled paper 2 is positioned so that the left side end thereof is aligned with reference position E when rolled paper 2 is conveyed through a regular position. Meandering detection sensor 60 outputs an end position detection signal, which is a voltage value proportional to displacement amount X from reference position E, to meandering controller 150. For instance when displacement amount X indicates a displacement from reference position E to boundary positions x1, x2 on the positive side (the right side or the positive side of the X-axis), the end position detection signal has voltage values +v1, +v2 proportional to the boundary positions. When displacement amount X indicates a displacement from reference position E to −x1, −x2 on the negative side (the left side or the negative side of the X-axis), the end position detection signal has voltage values −v1, −v2 proportional to the displaced positions.

As illustrated in FIGS. 5 and 6, the sheet detection sensor 63 is disposed along with meandering detection sensor 60 between second conveyance roller 14 and third conveyance roller 15 in the conveyance path of rolled paper 2. The sheet detection sensor 63 transmits a sheet detection signal to meandering controller 150, the sheet detection signal indicating whether or not rolled paper 2 is present in the conveyance path.

Meandering controller 150 as the controller receives those end position detection signals and sheet detection signal, and controls the rotation of meandering correction motor 28 via meandering correction motor driver 151 and controls the rotation of sheet up-and-down motor 43 via sheet up-and-down motor driver 154 based on the signals. It is to be noted that meandering correction motor driver 151 and meandering correction motor 28 correspond to the meandering correction driver.

Specifically, meandering controller 150 checks the end position detection signal from meandering detection sensor 60, and outputs a pulse signal according to a voltage V to meandering correction motor driver 151 to control the rotation of meandering correction motor 28. However, as illustrated in FIG. 7, when displacement amount X is within an allowable range of ±Δx with respect to reference position E, in other words, the end position detection signal (voltage) is within a range of ±Δx with respect to a corresponding voltage value, the control is not performed.

Here, when the end position detection signal (voltage V) is described in terms of displacement amount X, meandering controller 150 outputs a pulse(s) to meandering correction motor driver 151 in the following manner:

one positive pulse when $\Delta x(\Delta v)<X\leq x1(v1)$, two positive pulses when $x1(v1)<X\leq x2(v2)$, one negative pulse when $x1(-v1)\leq X<\Delta-x(-\Delta v)$, and two negative pulses when $x2(-v2)\leq X<\Delta-x1(-v1)$.

When pulse signal +nP is inputted, meandering correction motor driver 151 drives and rotates the rotational shaft of meandering correction motor 28 *n* turns in a predetermined direction of arrow A (FIG. 9). When pulse signal −nP is inputted, meandering correction motor driver 151 drives and rotates the rotational shaft of meandering correction motor 28 *n* turns in the opposite direction to arrow A (FIG. 9). As described later, the rotational direction is set so that detected displacement amount X of rolled paper 2 is reduced with the axial direction of tensioner roller 23 changed by the rotation.

Meandering controller 150 controls the conveyance of rolled paper 2 according to, for instance, information signal S1 which is received from the outside, such as a printer controller, and which indicates a device condition. Thus, LF motor driver 152 receives a conveyance control signal from meandering controller 150 to drive and rotate LF motor 11, and rotates second conveyance roller 14 and third conveyance roller 15 in the direction of the arrow (FIG. 6) at a predetermined rotational speed. First conveyance motor driver 153 receives a conveyance control signal from meandering controller 150 to drive and rotate first conveyance motor 47, and rotates first conveyance roller 13 in the direction of the arrow (FIG. 6) at a predetermined rotational speed. Here, meandering controller 150 performs a conveyance control so that first to third conveyance rollers 13, 14, 15 have the same conveyance speed.

It is to be noted that first conveyance motor driver 153 and first conveyance motor 47 correspond to the first conveyance driver, and LF motor driver 152 and LF motor 11 correspond to the second conveyance driver.

In addition, meandering controller 150 outputs a control signal for raising and lowering guide member 51 to sheet up-and-down motor driver 154 according to a sheet detection signal received from sheet detection sensor 63. Based on the control signal, sheet up-and-down motor driver 154 rotates the rotational shaft of sheet up-and-down motor 43 in the opposite direction to arrow B (FIG. 13) to lower guide member 51, or in the direction of arrow B to elevate guide member 51.

Figure 17A:
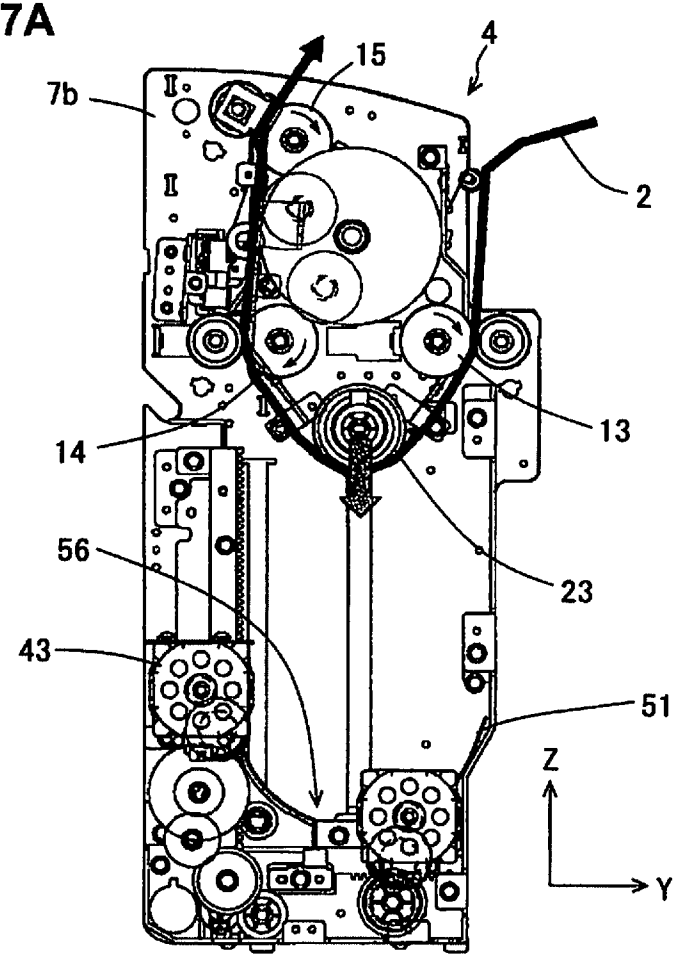
FIGS. 17A and 17B are each another view for illustrating the operation of the guide sheet unit, where
Figure 17B:
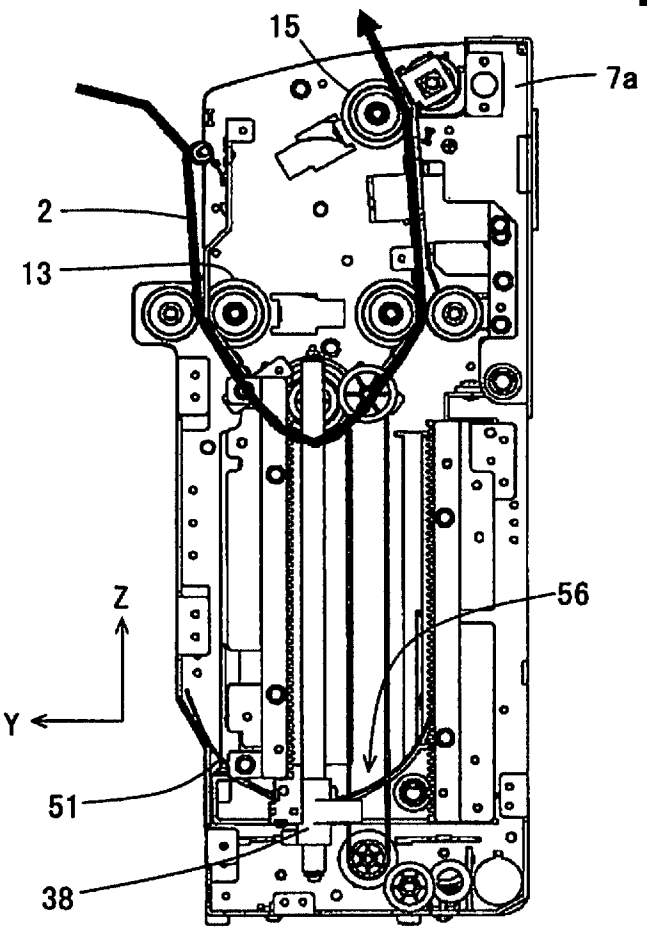
Figures 18A, 18B, 18C:
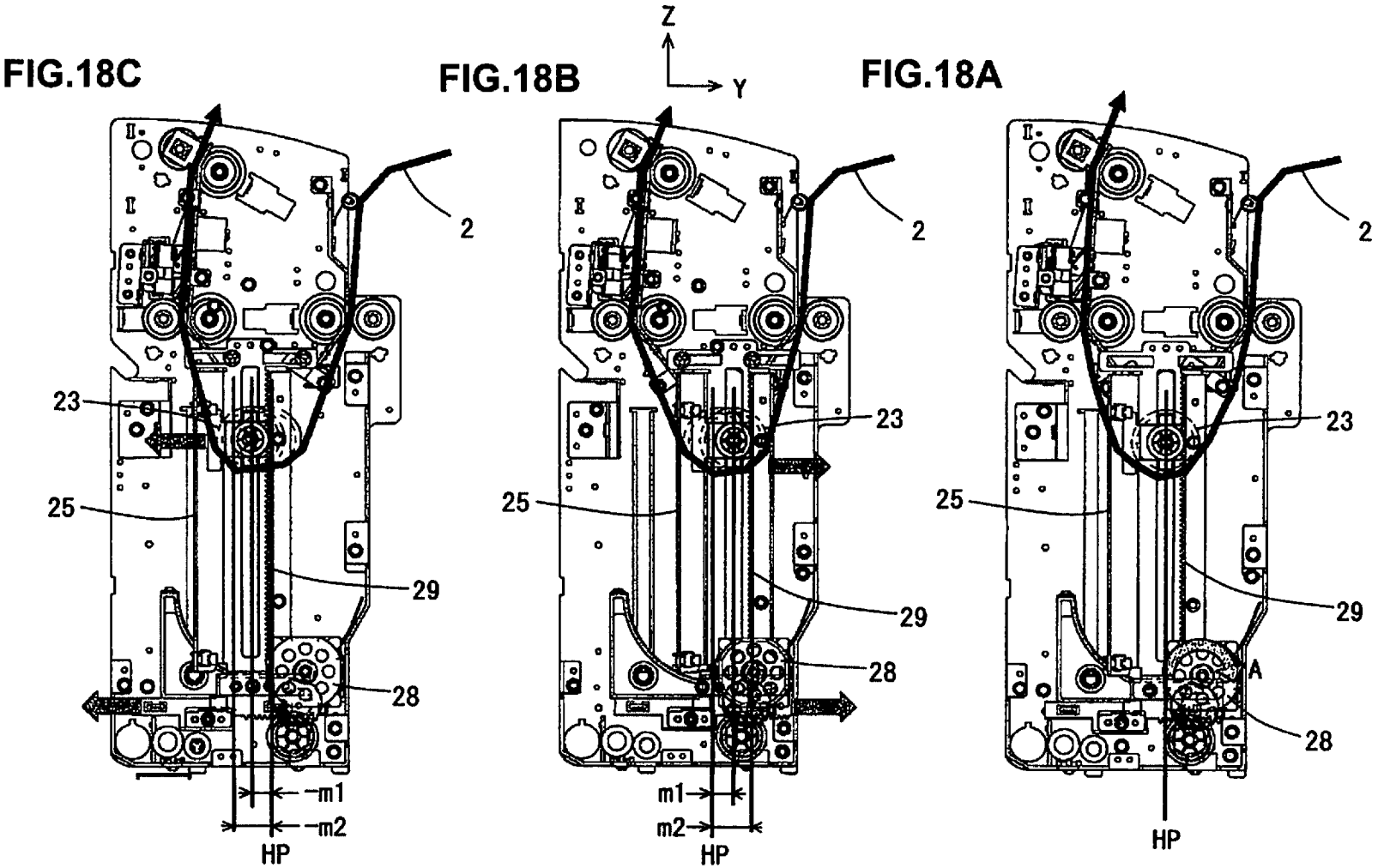
FIGS. 18A to 18C are each a view for illustrating the operation of the tensioner roller unit, specifically the main configuration diagram when the device is seen from the right side (the positive side of the X-axis)
Figure 19:
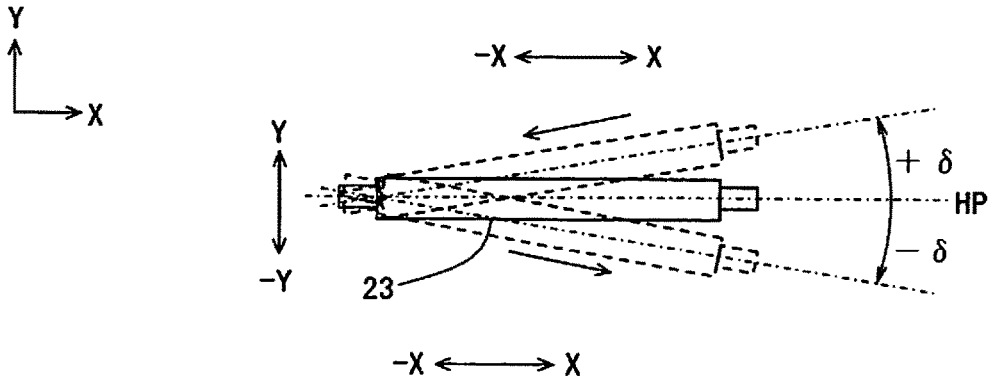
FIG. 19 is a view for illustrating the relationship between the inclination of the axial direction of a tension roller and the direction of movement of rolled paper in the tension roller unit.

In the configuration described above, a series of meandering correction operations performed by meandering correction unit 4 is described. FIGS. 16A to 17B are each a view for illustrating the operation of guide sheet unit 30. FIGS. 16A and 17A are each the main configuration diagram when the device is seen from the right side (the positive side of the X-axis), and FIGS. 16B and 17B are each the main configuration diagram when the device is seen from the left side (the negative side of the X-axis). FIGS. 18A to 20D are each a view for illustrating the operation of tensioner roller unit 20. FIGS. 18A to 18C are each the main configuration diagram when the device is seen from the right side (the positive side of the X-axis). FIG. 19 is a view for illustrating the inclination of the axial direction of tension roller 23. FIGS. 20A to 20D are each a view illustrating the inclination of the axial direction of tension roller 23 in each stage at the time of operation.

First, in roll sheet conveyance device 101 illustrated in FIG. 1, when rolled paper 2 mounted on rolled paper rotational shaft 120 is conveyed along the conveyance path to the downstream side by conveyance roller pairs 111 to 114 which are rotationally driven by a drive system (not illustrated), meandering controller 150, in synchronization with the conveyance, rotates first to third conveyance rollers 13, 14, 15 in the directions of respective arrows at a predetermined speed, and conveys rolled paper 2 along a conveyance path in meandering correction unit 4.

At the initial stage of the conveyance, guide member 51 is at the initial uppermost position, and thereby spacer 34*a* for tensioner roller 23 is mounted on projection portion 53*a* of right end member 53 of guide assembly 56 (FIGS. 16A and 16B) as illustrated in the portion enclosed by dotted line circle 200 in FIG. 6. Thus tensioner roller 23 remains at an upper initial position with a predetermined space maintained between guide members 51 and tensioner roller 23, the predetermined space allowing rolled paper 2 to pass through.

Figure 16A:
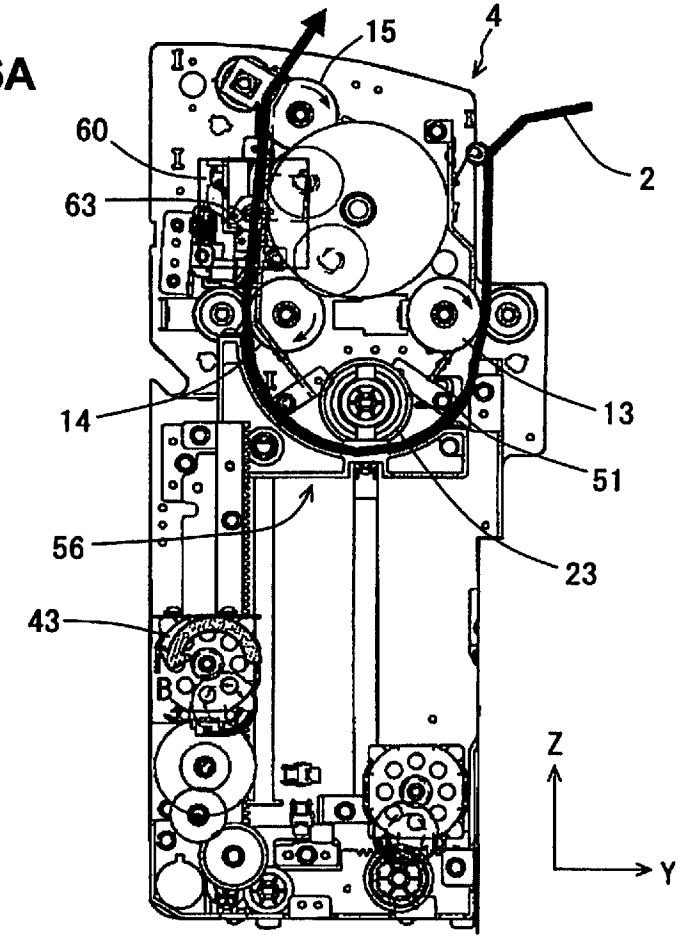
FIGS. 16A and 16B are each a view for illustrating the operation of the guide sheet unit, where
Figure 16B:
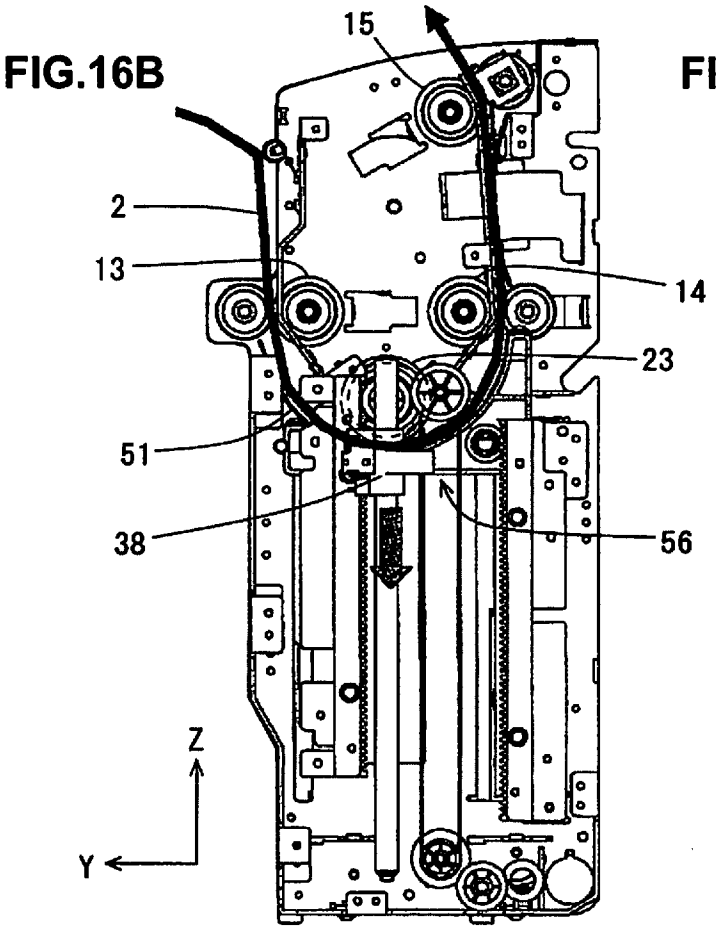

As illustrated in FIGS. 16A and 16B, the front end of conveyed rolled paper 2 passes through between guide member 51 and tensioner roller 23 and reaches second conveyance roller 14. Soon, rolled paper 2 passes through sheet detection sensor 63 and meandering detection sensor 60 (see FIG. 5, FIG. 6) and reaches third conveyance roller 15, and as illustrated in FIG. 2, rolled paper 2 is delivered from discharge outlet 115 to image formation unit 102.

When conveyed rolled paper 2 is detected by sheet detection sensor 63, meandering controller 150 rotates sheet up-and-down motor 43 in the opposite direction to arrow B to lower (negative direction of the Z-axis) guide assembly 56 including carriage 38.

As illustrated in FIGS. 17A and 17B, when guide member 51 is lowered, tensioner roller 23 is separated away from guide assembly 56 and rides on rolled paper 2, and the downward force due to the self-weight and the upward force due to the tension of rolled paper 2 cause tensioner roller 23 to move in an upward or downward direction so that the tension becomes substantially constant.

Next, the meandering correction processing is described with reference to FIG. 18A to 20D in the case where conveyed rolled paper 2 meanders and the left side end of rolled paper 2 is displaced to the left (− side and the negative side of the X-axis), and to the right (+ side and the positive side of the X-axis) with respect to reference position E of meandering detection sensor 60 illustrated in FIG. 7.

As described above, when meandering controller 150 detects a displacement amount X in the following range, meandering controller 150 rotates meandering correction motor 28 of tensioner roller unit 20 just one turn in the direction of arrow A corresponding to +1P (plus 1 pulse) as illustrated in FIG. 18A, and moves meandering correction bracket 25 rearward (positive side of the Y-axis) from the initial position (HP) by just a movement amount m1 as illustrated in FIG. 18B.

$$\Delta x(\Delta v)<X\leq x1(v1) \quad (1)$$

Figure 20A:
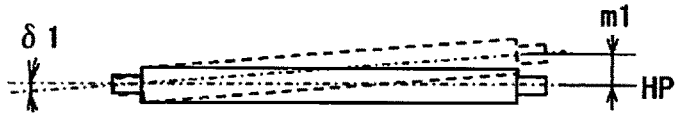
FIGS. 20A to 20D are each a view for illustrating the operation of the tension roller unit, and illustrate an inclination of the axial direction of the tension roller in each stage at the time of operation.

Accordingly, as illustrated in FIG. 20A, the right end side of tensioner roller 23 is inclined rearward (the positive side of the Y-axis) by correction angle δ1.

Here, the relationship is described between the inclination of tensioner roller 23 and the movement of rolled paper 2 to the right or left due to the inclination.

For instance, when meandering correction bracket 25 is moved rearward (positive side of the Y-axis) from the initial position (HP) by just a movement amount m1 as illustrated in FIG. 20A, correction angle δ of tensioner roller 23 is inclined to the positive side with respect to the initial position (HP) as illustrated in FIG. 19. At this point, in rolled paper 2 on the downstream side of tensioner roller 23, the tension on the right end side is higher than that on the left end side because of the relationship of the distance between tensioner roller 23 and second conveyance roller 14. Rolled paper 2 conveyed toward the downstream side slides in the direction of the arrow in which the tension is reduced, that is, the left direction (the negative side of the X-axis).

Figure 20B:
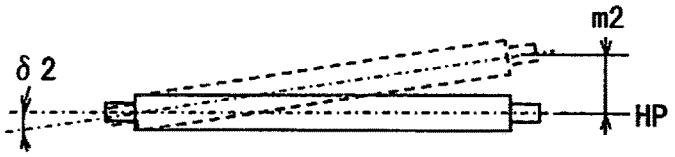
Figure 20C:
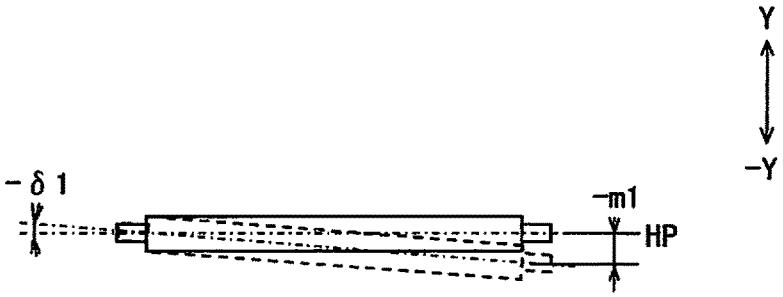

Conversely, when meandering correction bracket 25 is moved forward (negative side of the Y-axis) from the initial position (HP) by just a movement amount −m1 as illustrated in FIG. 18C, correction angle δ of tensioner roller 23 is inclined to the negative side with respect to the initial position (HP) as illustrated in FIG. 19 and FIG. 20C. At this point, in rolled paper 2 on the downstream side of tensioner roller 23, the tension on the right end side is lower than that on the left end side, and rolled paper 2 conveyed toward the downstream side slides in the direction of the arrow in which the tension is reduced, that is, the right direction (the positive side of the X-axis).

As described above, when meandering controller 150 detects a displacement amount X in the following range, meandering controller 150 rotates meandering correction motor 28 of tensioner roller unit 20 just two turns in the direction of arrow A corresponding to +2P (plus 2 pulses) as illustrated in FIG. 18A, and moves meandering correction bracket 25 rearward (positive direction of the Y-axis) from the initial position (HP) by just a movement amount m2 (=2×m) as illustrated in FIG. 18B.

$$x1(v1)<X\leq x2(v2) \quad (2)$$

Accordingly, as illustrated in FIG. 20B, the right end side of tensioner roller 23 is inclined rearward (the positive side of the Y-axis) by correction angle δ2, and rolled paper 2 slides in the left direction (the negative side of the X-axis) more quickly than in the case where displacement amount X is in the range of Expression (1).

On the other hand, as described above, when meandering controller 150 detects a displacement amount X in the following range, meandering controller 150 rotates meandering correction motor 28 of tensioner roller unit 20 just one turn in the opposite direction to arrow A illustrated in FIG. 18A, corresponding to −1P (minus 1 pulse), and moves meandering correction bracket 25 forward (negative side of the Y-axis) from the initial position (HP) by just a movement amount −m1 as illustrated in FIG. 18C.

$$-x1(-v1)\leq X<\Delta-x(-\Delta v) \quad (3)$$

Accordingly, as illustrated in FIG. 20C, the right end side of tensioner roller 23 is inclined forward (the negative side of the Y-axis) by correction angle −δ1. At this point, in rolled paper 2 on the downstream side of tensioner roller 23, the tension on the right end side is lower than that on the left end side, and rolled paper 2 conveyed toward the downstream side slides in the direction of the arrow in which the tension is reduced, that is, the right direction (the positive side of the X-axis).

Furthermore, as described above, when meandering controller 150 detects a displacement amount X in the following range, meandering controller 150 rotates meandering correction motor 28 of tensioner roller unit 20 just two turns in the opposite direction to arrow A illustrated in FIG. 18A, corresponding to −2P (minus 2 pulses), and moves meandering correction bracket 25 forward (negative side of the Y-axis) from the initial position (HP) by just a movement amount −m2 (=2×−m) as illustrated in FIG. 18C.

$$-x2(-v2)\leq X<\Delta-x1(-v1) \quad (4)$$

Figure 20D:
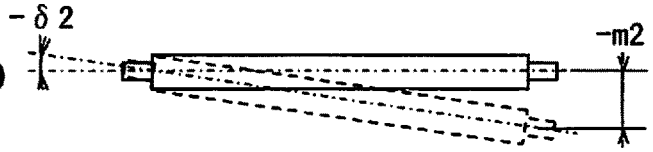

Accordingly, as illustrated in FIG. 20D, the right end side of tensioner roller 23 is inclined rearward (the negative side of the Y-axis) by correction angle −δ2, and rolled paper 2 slides in the right direction (the positive side of the X-axis) more quickly than in the case where displacement amount X is in the range of Expression (3).

In this manner, meandering controller 150 detects displacement amount X and repeats the meandering correction processing described above, and performs a control so that the left side end of rolled paper 2 falls within the allowable range of ±Δx with respect to reference position E illustrated in FIG. 7. Once the left side end falls within the allowable range of ±Δx, meandering controller 150 terminates the meandering correction control and performs an operation of returning tensioner roller 23 to the HP position. Specifically, meandering controller 150 reversely rotates meandering correction motor 28 for a predetermined number of pulses for the movement made.

Then the above-described meandering correction control is repeated for every predetermined feed amount X(mm) of rolled paper 2 or for every predetermined elapsed time, and the control is performed so that the left side end of rolled paper 2 falls within the allowable range of ±Δx with respect to reference position E illustrated in FIG. 7. Therefore, as long as detected displacement amount X falls within the allowable range of ±Δx with respect to reference position E, meandering correction control is not performed at the correction timing during the relevant period.

Also, rolled paper 2 is cut by a cutter (not illustrated) which is disposed on the upstream side of sheet detection sensor in the conveyance direction. When no rolled paper 2 is detected by sheet detection sensor 63, meandering controller 150 returns guide assembly 56 to the initial position. Accordingly, tensioner roller 23 is also returned to the initial position.

As described above, in the meandering correction device of the present embodiment, tensioner roller 23 is provided with the function of maintaining a uniform tension of rolled paper 2 and the function of correcting a meandering of rolled paper 2. Thus it is possible to correct meandering while maintaining a uniform tension of rolled paper 2. In contrast to the case where these adjustments are made by separate methods, simplification of the device and a space saving are achieved. In addition, any adjustment of the parallelism of the tensioner roller is unnecessary. Thus the effect of saving time and effort for the adjustment work may be expected. Furthermore, the tension is applicable to rolled paper 2 by the weight of tensioner roller 23, and thus a drive control unit which applies a tension force does not have to be separately provided.

Second Embodiment

Figure 21:
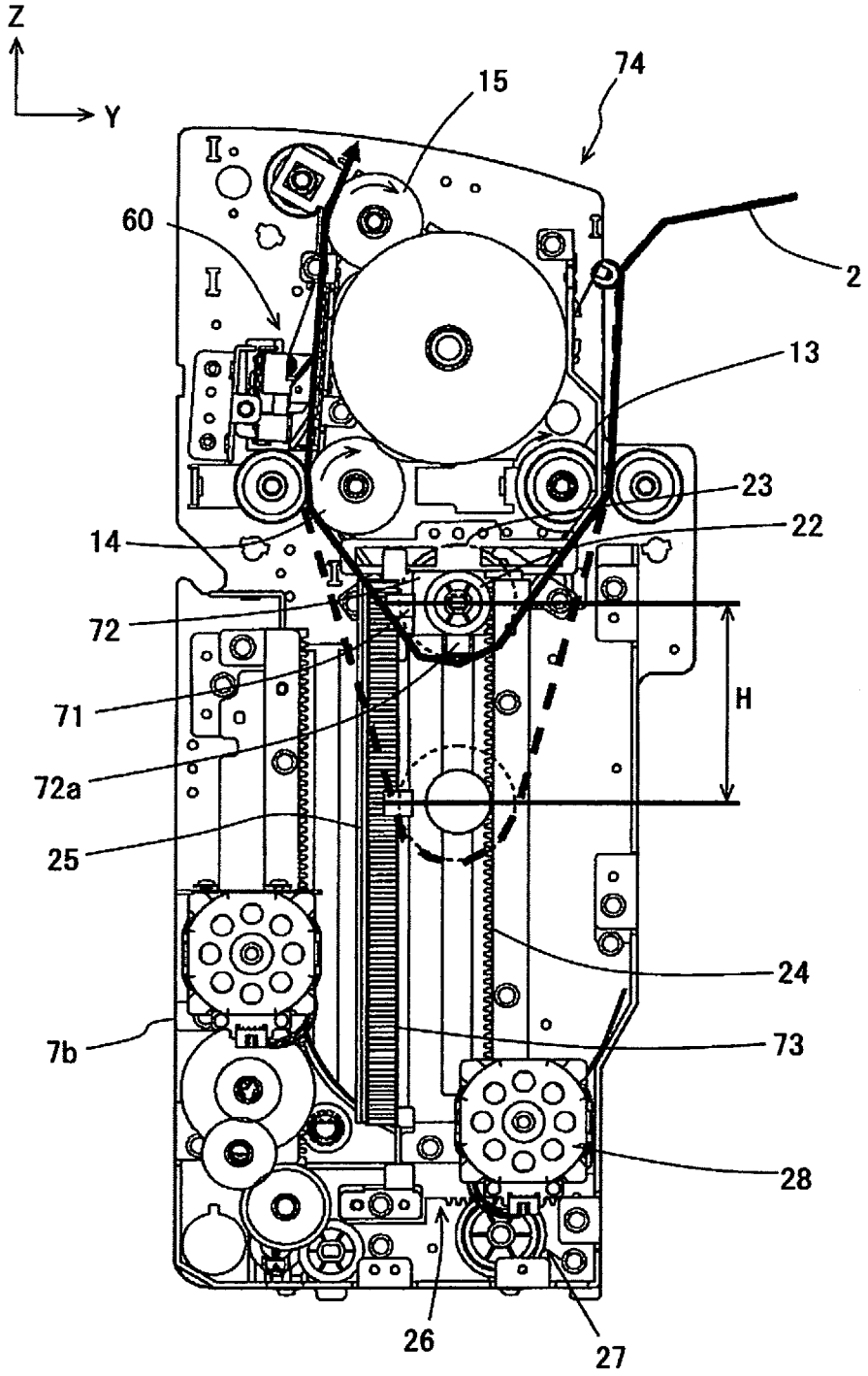
FIG. 21 is the main configuration diagram of the configuration of a second embodiment of the meandering correction device according to the invention when the device is seen from the right side (the positive side of the X-axis)
Figure 22:
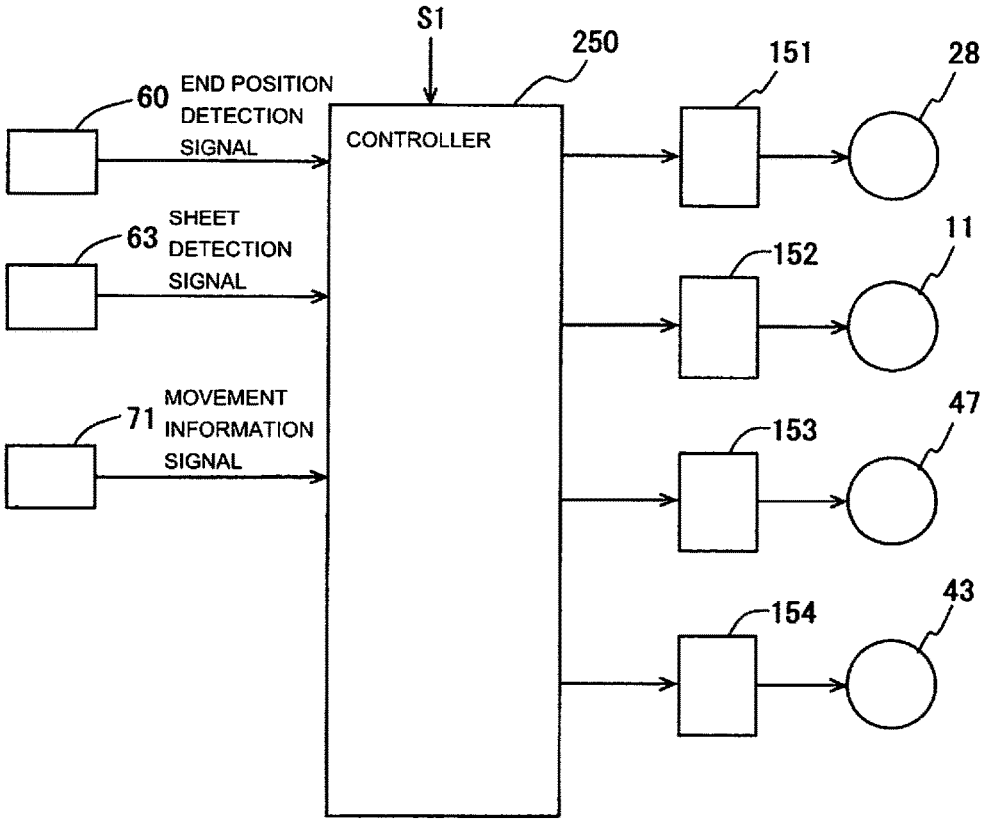
FIG. 22 is a block diagram illustrating the main configuration of the control system of the meandering correction unit in the second embodiment.

FIG. 21 is the main configuration diagram for the configuration of a second embodiment of the meandering correction device according to the invention when the device is seen from the right side (the positive side of the X-axis). FIG. 22 is a block diagram illustrating the main configuration of a control system of meandering correction unit 74. Meandering correction unit 74 mainly differs from meandering correction unit 4 of the first embodiment illustrated in FIGS. 16A and 16B in that linear sensor 71 is disposed at right bracket 72 (34 in the first embodiment) and linear scale 73 is disposed at a position of meandering correction bracket 25, the position being opposed to linear sensor 71. Accordingly, a method of controlling meandering controller 250 (150 in the first embodiment) is partially different.

Thus, portions of meandering correction unit 74 in the present embodiment in common with meandering correction unit 4 in the first embodiment are denoted by the same symbol or the drawing and detailed description are omitted, and different points are described intensively.

Similarly to bracket 34 (FIG. 6) described above, along with the movement of tensioner roller 23 in the vertical direction (the Z-axis direction), right bracket 72 moves while maintaining the same posture. Linear sensor 71 disposed at bracket 72 moves along linear scale 73 which is disposed at meandering correction bracket 25 and is opposed to linear sensor 71. A movement information signal indicating the movement direction and the movement amount is outputted to meandering controller 250 (FIG. 22).

Meandering controller 250 recognizes at least descent distance H of tensioner roller 23 from the initial position based on the movement information. It is to be noted that the initial position of tensioner roller 23 is an upper position where tensioner roller 23 remains because spacer 72*a* of right bracket 72 is mounted on projection portion 53*a* of right end member 53 when guide member 51 is at the uppermost position, as illustrated in the aforementioned FIG. 6.

In accordance with the later-described conditions, meandering controller 250 temporarily causes first conveyance motor 47, that drives first conveyance roller 13, to rotate at a speed faster than that of LF motor 11 that drives second conveyance roller 14 and third conveyance roller 15, thereby intentionally lowering tensioner roller 23, which tries to maintain a uniform tension, vertically downward (the negative direction of the Z-axis). In a stage where tensioner roller 23 is lowered by a desired amount, meandering controller 250 performs position adjustment control on tensioner roller 23 to return to a constant speed. The position adjustment control is performed under the later-described conditions so that descent distance H (FIG. 21) of tensioner roller 23 is substantially proportional to the absolute value of displacement amount X of the left side end of rolled paper 2 with respect to reference position E of meandering detection sensor 60 illustrated in FIG. 7.

Here, the relationship between displacement amount X of the left side end of rolled paper 2 with respect to reference position E of meandering detection sensor 60 illustrated in FIG. and descent distance H of tensioner roller 23 is described with reference to FIG. 23 and FIG. 24. Because displacement amount X is detected in the vicinity of second conveyance roller 14, a description is given by assuming that the displacement amount in the vicinity of second conveyance roller 14 is the provisional displacement amount X.

Figure 23:
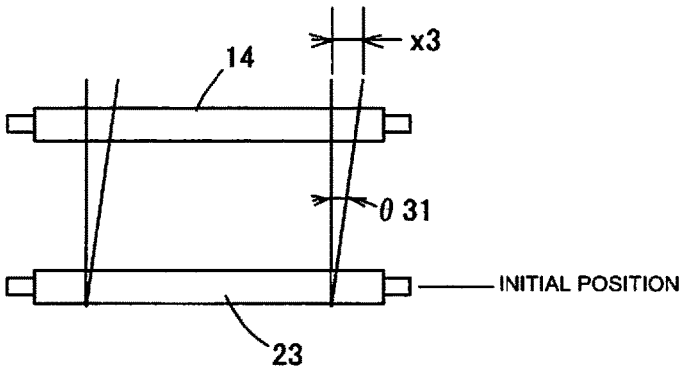
FIG. 23 is a view illustrating displacement angle θ31 of the rolled paper when the tensioner roller is at the initial position and x3 is detected as displacement amount X.

FIG. 23 illustrates displacement angle θ31 of rolled paper 2 at the position of tensioner roller 23 when tensioner roller 23 is, for instance, the initial position illustrated in FIG. 21 and x3 is detected as displacement amount X. FIG. 24 illustrates displacement angle θ32 of rolled paper 2 at the position of tensioner roller 23 when tensioner roller 23 is, for instance, at the position with descent distance H illustrated in FIG. 21 and x3 is similarly detected as displacement amount X.

Figure 24:
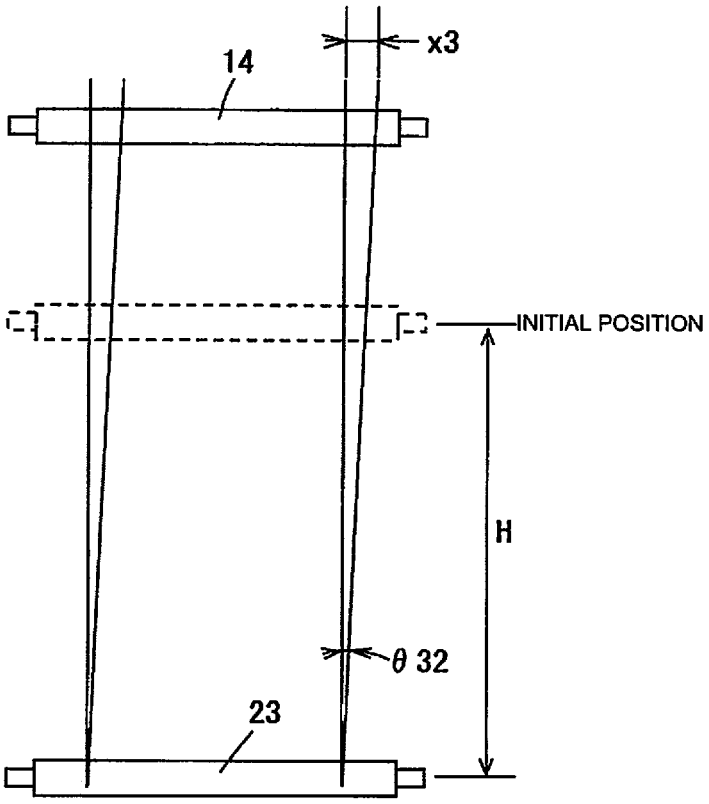
FIG. 24 is a view illustrating displacement angle θ32 of the rolled paper when the tensioner roller is at a lowered position and x3 is detected as displacement amount X.

As is apparent from FIGS. 23 and 24, when the same displacement amount x3 is detected, displacement angle θ31 with tensioner roller 23 at the initial position and displacement angle θ32 with tensioner roller 23 at the position with descent distance H have the relationship of θ31 >θ32 and descent distance H is increased. In other words, it is understood that displacement angle θ32 decreases as the position of tensioner roller 23 is lowered.

As illustrated in FIG. 19, when meandering correction control is performed in which the meandering of rolled paper 2 is corrected by adjusting correction angle δ (see FIGS. 20A to 20D) of tensioner roller 23 so that displacement amount X falls within the allowable range of ±Δx, the smaller the displacement angle 9 illustrated in FIGS. 23 and 24, the smaller the control amount for meandering correction motor 28, and thus the control time is expected to be reduced.

Therefore, when meandering correction control is performed by meandering controller 250 in the present embodiment, for a larger displacement amount X detected, position adjustment control in which the position of tensioner roller 23 is lowered is first performed, then meandering correction control is performed and quickly completed. However, in the case where tensioner roller 23 when a displacement amount is detected is already lower than the later-described target movement position, a meandering correction control is immediately performed without performing a position adjustment control.

In the configuration described above, the position adjustment control and the meandering correction control of meandering correction unit 74 are described.

As described above, meandering controller 250 performs the position adjustment control of tensioner roller 23 and the meandering correction control as described in the first embodiment under the following conditions:

(1) Position adjustment control is performed at the timing of before the meandering correction control is performed.

(2) In the case where descent distance H for the location of tensioner roller 23 when a displacement amount is detected is larger than a predetermined target descent distance Hx which corresponds to the absolute value of detected displacement amount X, in other words, in the case where tensioner roller 23 is already lower than a target movement position, the position adjustment control is not performed.

A specific example of control is described.

When rolled paper 2 continues to be conveyed, tensioner roller 23 is at descent distance Hs (position when displacement amount X is detected), displacement of xn is detected on the right side (positive direction of the X-axis) as displacement amount X, and target descent distance Hxn (target position) corresponding to the absolute value of xn is greater than Hs. In other words, when the position of tensioner roller 23 at the time of detection of the displacement amount, is higher than a target position, meandering controller 250 first performs a position adjustment control and lowers tensioner roller 23 to a target position (target descent distance Hxn), and performs a meandering correction control at the target position.

Also when tensioner roller 23 is at descent distance Hs (<Hxn) and displacement of −xn is detected on the left side (negative direction of the X-axis) as displacement amount X, the position adjustment control and meandering correction control are performed similarly.

When rolled paper 2 continues to be conveyed, tensioner roller 23 is at descent distance Hs (position when displacement amount X is detected), displacement of xn is detected on the left or right side (the X-axis direction) as displacement amount X, and target descent distance Hxn (target position) corresponding to the absolute value of xn is less than or equal to Hs. <In other words, when the position of tensioner roller 23 at the time of displacement amount detection is lower than or equal to a target position, meandering controller 250 immediately performs the meandering correction control without performing position adjustment control.

It is to be noted that in the present embodiment, a description is given in which the control described in the first embodiment is performed as the meandering correction control. However, the aforementioned boundary values x1, x2 may be changed according to, for instance, the position of tensioner roller 23 positioned by the position adjustment control.

Although the condition (2) has been set as a control condition in the present embodiment, if tension control is satisfactory, the control condition (2) may be eliminated.

In each of the aforementioned embodiments, an example has been presented in which image formation unit 102 having a print function is disposed in the rear stage of roll medium conveyance device 101 as illustrated in FIG. 1. However, for instance, an image formation unit may be disposed that has an image reading function of reading information from rolled paper, and various aspects may be provided.

As described above, with the meandering correction device in the present embodiment, similar effects to those in the first embodiment are obtained, and in addition, the correction time for meandering can be reduced.

It is to be noted that although terms such as "upper", "lower", "left", "right", "front", "rear" have been used in the description of the embodiments, this is for the sake of convenience and absolute positional relationship for disposition of the meandering correction device is not restricted.

In the embodiments, an example has been described in which the meandering correction device is used by an image formation apparatus that performs printing on rolled paper. However, the meandering correction device may be used for a roll medium conveyance device that conveys a medium wound in a roll, and thereby the invention is applicable to a device that performs not only printing but also reading an image.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A meandering correction device for a roll medium, comprising:

a first roll medium conveyance unit;

a second roll medium conveyance unit disposed downstream of the first roll medium conveyance unit in a conveyance path for a roll medium;

a meandering correction roller located between the first and second roll medium conveyance units in the conveyance path and being vertically downwardly in contact with the roll medium to thereby apply a tension to the roll medium;

a meandering correction movement member; and a base, wherein the meandering correction roller comprises a rotational shaft whose direction is changeable, the meandering correction movement member vertically slidably holds one end side of the rotational shaft of the meandering correction roller; and the base vertically slidably holds another end side of the rotational shaft of the meandering correction roller, and horizontally slidably holds the meandering correction movement member, a change in the direction of the rotational shaft causes a position of the roll medium in contact with the meandering correction roller to move in the direction of the rotational shaft, the meandering correction roller comprises:

the rotational shaft;

a roller freely rotatably held by the rotational shaft;

a first end gear fixedly disposed at one end portion of the rotational shaft; and a second end gear fixedly disposed at another end portion of the rotational shaft, the base comprises a first vertical rack engaged with the first end gear and extending vertically, and the meandering correction movement member comprises a second vertical rack engaged with the second end gear and that extends vertically.

2. The meandering correction device according to claim 1, wherein the first roll medium conveyance unit and the second roll medium conveyance unit each comprise a conveyance roller that is rotationally driven, and a driven roller that pinches the roll medium with the conveyance roller and that is in pressure contact with the conveyance roller.

3. The meandering correction device according to claim 1, further comprising a guide member that is located between the first and second roll medium conveyance units in the conveyance path, vertically below the roll medium to be conveyed, and that guides the roll medium while being held in a vertically slidable manner.

4. A roll medium conveyance device comprising:

the meandering correction device according to claim 1;

a meandering detector disposed downstream of the second roll medium conveyance unit in a conveyance direction of the roll medium and that detects meandering of the roll medium and outputs meandering information;

a meandering correction driver that slidably drives the meandering correction movement member; and a controller that controls the meandering correction driver based on the meandering information, wherein the roll medium conveyance device corrects the meandering of the roll medium.

5. The roll medium conveyance device according to claim 4, further comprising a sheet supply unit that is disposed on an upstream side of the meandering correction device in the roll medium conveyance direction and that delivers the roll medium to the meandering correction device.

6. The roll medium conveyance device according to claim 4, further comprising:

a first conveyance driver that drives the first roll medium conveyance unit under control of the controller; and a second conveyance driver that drives the second roll medium conveyance unit under control of the controller, wherein the controller causes the first roll medium conveyance unit to convey the roll medium at a speed faster than that of the second roll medium conveyance unit based on the meandering information, thereby lowering a height level of the meandering correction roller, and subsequently controls the meandering correction driver.

7. An image processing device comprising:

the roll medium conveyance device according to claim 4; and an image processor that performs image processing on the roll medium which is discharged from the roll medium conveyance device.

* * * * *